US007235288B2

(12) United States Patent
Kajander et al.

(10) Patent No.: US 7,235,288 B2
(45) Date of Patent: Jun. 26, 2007

(54) POLYMERIC BONDING OF GLASS FIBER REINFORCEMENTS WITH SILANE BASED COATINGS IN GYPSUM BOARD

(75) Inventors: Richard Emil Kajander, Toledo, OH (US); Lance Wang, Parker, CO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 10/913,768

(22) Filed: Aug. 6, 2004

(65) Prior Publication Data

US 2005/0202228 A1 Sep. 15, 2005

Related U.S. Application Data

(63) Continuation-in-part of application No. 10/796,950, filed on Mar. 10, 2004.

(51) Int. Cl.
*B32B 17/12* (2006.01)
*B32B 27/04* (2006.01)

(52) U.S. Cl. ..... 428/294.7; 428/294.1; 442/104

(58) Field of Classification Search ..... 524/253, 524/837, 156, 606; 442/104; 428/294.7, 428/294.1

See application file for complete search history.

(56) References Cited

U.S. PATENT DOCUMENTS 4,174,230 A * 11/1979 Hashimoto et al. ..... 106/660
4,241,136 A * 12/1980 Dereser ..... 428/378
4,349,610 A * 9/1982 Parker ..... 428/447
4,645,548 A * 2/1987 Take et al. ..... 156/39
4,824,890 A * 4/1989 Glover et al. ..... 524/253
4,935,301 A * 6/1990 Rerup et al. ..... 428/375
5,786,080 A * 7/1998 Andersen et al. ..... 428/357
2004/0082240 A1* 4/2004 Rodrigues ..... 442/104
2004/0082241 A1* 4/2004 Rodrigues ..... 442/104

* cited by examiner

*Primary Examiner*—N. Edwards
(74) *Attorney, Agent, or Firm*—Robert D. Touslee

(57) ABSTRACT

A bond is created between a gypsum matrix formed from an aqueous acidic gypsum slurry comprising a monomer mixture. The monomer mixture is composed of a monomer having acidic functionality and a monomer having hydroxyl or amine functionality. A silane-based sizing composition is coated onto glass fibers causing a cross-linking network of silane and monomer mixture to form during curing of the gypsum board. Hydrophilic water extraction at the gypsum matrix-sizing interface reduces void formation and promotes bonding with the crosslinked monomer mixture and growth of smaller gypsum crystals within larger crystals in microstructurally identifiable regions adjacent to the glass fiber. A bond is created between a gypsum matrix formed from an aqueous acidic gypsum slurry comprising a monomer mixture. The monomer mixture is composed of a monomer having acidic functionality and a monomer having hydroxyl or amine functionality. A silane-based sizing composition is coated onto glass fibers causing a cross-linking network of silane and monomer mixture to form during curing of the gypsum board. Hydrophilic water extraction at the gypsum matrix-sizing interface reduces void formation and promotes bonding with the crosslinked monomer mixture and growth of smaller gypsum crystals within larger crystals in microstructurally identifiable regions adjacent to the glass fiber. Alternatively, the silane based sizing composition has branched chains that diffuse into a wet gypsum mix containing the monomer mixture. During gypsum cure, the diffusion and crosslinking of monomer mixture triggers formation of interpenetrating pseudo polymeric networks within a microstructurally identifiable region adjacent to the glass fiber. Bonds formed between the gypsum matrix and the silane based sizing composition increase the strength, flexure resistance and nail pull out resistance of the gypsum board.

21 Claims, 3 Drawing Sheets

Fig. 2a
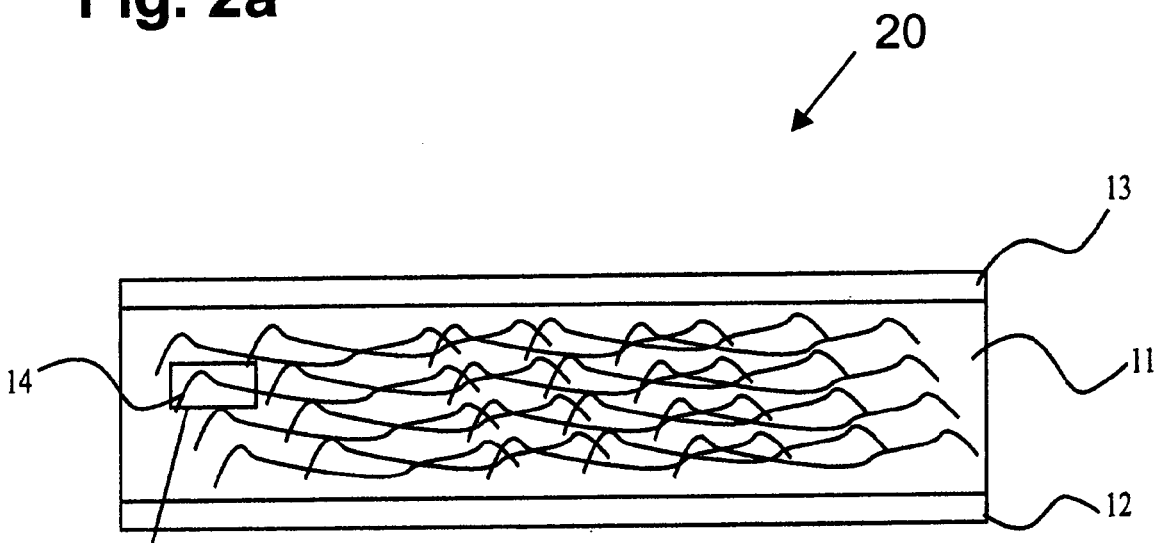
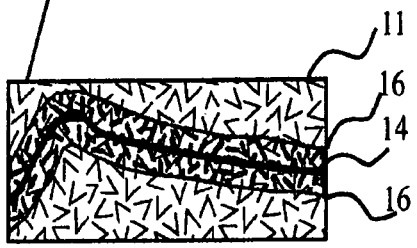
Fig. 2b

POLYMERIC BONDING OF GLASS FIBER REINFORCEMENTS WITH SILANE BASED COATINGS IN GYPSUM BOARD

BACKGROUND OF THE INVENTION

This is a Continuation-In-Part of application Ser. No. 10/796,950, filed Mar. 10, 2004, the disclosures of which is hereby incorporated in its entirety by reference thereto.

FIELD OF THE INVENTION

The present invention relates to an improved gypsum board for use in building construction and to a process for its manufacture; and more particularly, to a gypsum board having a gypsum matrix formed from a gypsum slurry that includes polymer forming additives and glass fibers coated with a silane sizing that provides improved fiber bonding with superior gypsum board flexure strength and nail pullout resistance.

DESCRIPTION OF THE PRIOR ART

Gypsum wallboard and gypsum panels are traditionally manufactured by a continuous process. The conventional process for manufacturing gypsum wallboard includes premixing of dry ingredients of the core composition, which can include calcium sulphate hemihydrate ($CaSO_4.½H_2O$, also known as calcined gypsum, stucco, and plaster of Paris), accelerator, starch, glass fiber and others. The premix of dry ingredients is then mixed with "wet" portion of the core composition in a pin mixer. The "wet" portion can include water, foaming agent, paper pulp, fluidity-increasing agent, and other conventional additives. Various additives, e.g. cellulose and glass fibers, are often added to the slurry to strengthen the gypsum core. Starch is frequently added to the slurry in order to improve the adhesion between the gypsum core and the facing.

The resulting gypsum slurry is continuously deposited to form a gypsum wallboard core between two continuously supplied moving sheets of cover paper. The two cover sheets are typically a pre-folded face paper and a backing paper. As the gypsum slurry is deposited onto the face paper, the backing paper is laid over the gypsum slurry and bonded to the pre-folded edges of the face paper with a suitable adhesive. The enclosed gypsum core slurry is then sized for thickness through forming plates or roller bars and allowed to set between two cover sheets, thereby forming a board. The setting process is a rehydration reaction that transforms calcium sulfate hemihydrate to calcium sulfate dihydrate, shown as follows.

$$CaSO_4.½H_2O+1½H_2O \rightarrow CaSO_4.2H_2O+\text{Heat}$$

Once the gypsum core has set sufficiently, the continuously produced board is cut into desired lengths and vertically stacked. After the cutting and stacking step, the gypsum boards are fed into drying ovens or kilns to evaporate the excess water. Inside the drying ovens, the boards are blown with hot drying air. After the dried gypsum boards are removed from the ovens, the ends of the boards are trimmed off and the boards are cut to desired sizes. The boards are commonly sold to the building industry in the form of sheets. These sheets are usually 4 feet wide, 8 to 12 feet long and 0.5 to 1 inches thick, the width and length dimensions defining the two faces of the board.

Wallboard formed of a gypsum core sandwiched between facing layers is used in the construction of virtually every modern building. In its various forms, the gypsum board is used as an interior or exterior surface for walls, ceilings and the like. The gypsum board is relatively easy and inexpensive to install, finish, and maintain, and depending on the composition of the gypsum matrix, may be relatively fire resistant. A number of patents discuss various reinforcement fibers and other hydrated matrices included in the gypsum matrix.

U.S. Pat. No. 4,241,136 to Dereser et al. (hereinafter the '136 patent) discloses a process and composition for treating glass fibers for use in reinforcement of cementitious materials. The fibers are first sized with a cationic fiber forming organic polymer and then with a second coating containing an anionic film-forming organic polymer. The resulting fibers are said to have good wetting and dispersibility characteristics. The '136 patent suggests that the high surface charge density of asbestos fibers, in combination with a high specific surface area, permits them to flocculate cement mixed therewith, thereby providing a substantial degree of reinforcement to structural articles. However, replacement of asbestos fibers with glass is said not to have the expected benefit, in that the glass fibers tend to adhere together and thereby inhibit the removal of water during mat or board production. In addition, the much lower specific surface area of glass fibers results in poor retention of either cement or water thereon, in comparison with asbestos. The glass fibers do not have similar surface charges and the '136 patent's sizing process is ineffective in bonding exclusively glass fibers without asbestos. Furthermore, the '136 patent's sizing is not a silane based composition and is not bonded to gypsum using a polymer.

U.S. Pat. No. 4,349,610 to Parker discloses a method for improving the water repellency of a naturally porous moisture-containing paper web. The method involves treating the web with a coating composition containing an alkyl alkoxysiloxane, as its active coating ingredient, which reacts with the moisture contained in the paper web to produce a polymer and an alcohol by-product. The polymer substantially improves the water repellency of the paper web, while the web retains substantially the porosity and the strength characteristics it had in the untreated state. The coating composition attaches to paper, making the paper water repellant; it does not attach to glass fibers.

U.S. Pat. No. 4,710,405 to Griver et al. (hereinafter the '405 patent) discloses a method for improving the adhesion of silicone elastomers to substrates. The method comprises mixing an anionically polymerized polydiorganosiloxane, in the form of an emulsion that cures into a silicone elastomer upon removal of the water, and an amine functional polydiorganosiloxane co-oligomer of the formula

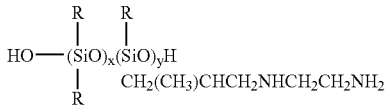

where R is a monovalent alkyl radical having from 1 to 6 carbon atoms, wherein x is from 1 to 250, and y is from 2 to 50. The mixture is applied to a substrate and allowed to dry to yield a silicone elastomer adhered to the substrate in a cohesive manner. This silane based polymeric composition does not have capability of adhering to a glass fiber reinforcement or interacting with a gypsum matrix to create a bond between the glass fiber reinforcement and the gypsum matrix. Furthermore, the '405 patent does not use a polymer to attach a silicone polymer with a gypsum matrix.

U.S. Pat. No. 4,824,890 to Glover et al. discloses film forming silicone microemulsions. A curable, reinforced polydiorganosiloxane microemulsion is prepared by adding from 5 to 30 parts by weight of colloidal silica per 100 parts by weight of polydiorganosiloxane in the microemulsion and from 1 to 5 parts by weight of dialkyltindicarboxylate catalyst per 100 parts by weight of the microemulsion to a polydiorganosiloxane microemulsion. The curable, reinforced polydiorganosiloxane emulsion can be cast into coherent, elastomeric films of less than 0.4 micrometer thickness. The patent does not disclose a silane based composition added to a glass fiber and incorporated and bonded with a gypsum matrix in a gypsum board using a polymeric binder.

U.S. Pat. No. 4,935,301 to Rerup et al. relates to a cement composite containing glass fibers encapsulated with a polymeric coating which is formed from an organic solution of an interpolymer complex of an anionic polymer and a cationic polymer. The fiber reinforcement is said to impart to the composite improved high apparent toughness, ductility, and flexural and tensile strengths, along with improved resistance to embrittlement and strength loss with age. The fibers are disposed in bundles which are encapsulated with an elastomeric material, wherein the encapsulant wraps the bundles of fibers but does not coat the individual fibers. Nor does the coating impregnate the bundle or fill the voids between the individual fibers. The fibers are disposed in any cementitious matrix, including Portland cement, concrete, mortar, gypsum, and hydrous calcium silicate. There is no interaction between the polymeric encapsulant and the gypsum matrix, and the polymeric encapsulant does not create a bond between the reinforcing fiber and the gypsum matrix.

U.S. Pat. No. 5,407,536 to Razac et al. (hereinafter the '536 patent) provides improved glass fiber dispersions for making glass fiber mats by a wet-laid process. A small amount of an alkyl amidoalkyl sultaine surfactant is mixed with chopped glass fibers in water. The resulting dispersion may be formed at relatively high glass fiber concentrations, permitting high quality glass fiber mats to be made at high production rates. The glass fibers have a diameter of about 3 to 20 μm and are in the form of filaments or strands that are generally chopped into bundles 0.5 to 3 inches long. The surfactant is present at a concentration of 5–500 ppm of solution. Alternatively, the glass fibers may be coated, e.g. by spraying, and subsequently dispersed in water. Use of other surfactants is also disclosed. The '536 patent discloses a surfactant that changes the wetting character of the glass fibers and does not coat individual glass fibers with a silane based sizing composition and bond the silane based coating to a gypsum matrix using a polymeric composition.

U.S. Pat. No. 5,429,839 to Graiver et al. (hereinafter the '839 patent) discloses a method for grafting preformed hydrophillic polymers onto hydrophobic polymer substrates. Coatings of hydrophilic organic polymers, such as polyvinyl alcohol, are grafted to substrates formed from hydrophobic organic polymers and polyorganosiloxanes by exposing the surface of the substrate to an aqueous solution of the hydrophilic poller in the presence of a solubilized compound of tetravalent cerium that preferably contains hydroxyl or amino groups as ligands. The '839 patent discloses aqueous hydrophilic coating compositions for hydrophobic substrates formed from organic polymers or polyorganosiloxanes and does not disclose coating a silane based composition onto a glass fiber and bonding the silane based coating to a gypsum matrix using a polymeric composition.

U.S. Pat. No. 5,786,080 to Andersen et al. discloses compositions and methods for the deposition of ettringite (3CaO—Al2O3.3Ca(SO4).30–32H2O) onto the surfaces of fibers, aggregates, or other fillers. The ettringite is produced in situ within an aqueous suspension while in proximity of the fibers, aggregates, or fillers, to form a mineralized composite material comprising ettringite coated fibers, aggregates or other fillers. The ettringite-coated materials can be added to hydraulically settable materials to improve the chemical and mechanical bond between the fibers or other substrate within the resulting hardened hydraulically settable materials, particularly cementitious or concrete material. The presence of the coated fiber materials is said to generally increase the toughness, flexibility, tensile strength, and flexural strengths of the composite and articles made therefrom. It is indicated that the ability of fibers to modify the mechanical properties of a composite is dependent on the strength of the bonding between the fibers and the matrix material. The ettringite process is said to increase the roughness of the coated fibers, thereby enhancing the mechanical interlocking with the matrix over that achieved with relatively smooth glass fibers. The ettringite composition is an inorganic coating and not a silane based coating. The patent does not utilize a polymeric composition to bond coated fibers with a gypsum matrix. In addition, the ettringite deposition does not result in a gypsum board that is both flexure resistant and exhibits superior nail pull out.

U.S. Pat. No. 6,416,861 to Lee (hereinafter the '861 patent) discloses organosilicon compounds and uses thereof. The '861 disclosure provides a compound of the following formula:

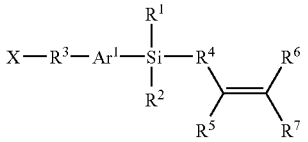

wherein each of $R^1$ and $R^2$ are independently aryl, $C_1$–$C_6$ alkyl, or $C_3$–$C_{20}$ cycloalkyl; $R^3$ is a bond or $C_1$–$C_{10}$ alkylene; $R^4$ is $C_1$–$C_{10}$ alkylene; each of $R^5$, $R^6$ and $R^7$ is independently H or $C_1$–$C_6$ alkyl; $Ar^1$ is aryl or heteroaryl; and X is a functional group. The '861 patent disclosure provides synthesis of various silicone moieties for biological application. These compounds provide a variety of different functional groups upon which further chemical reaction can be performed to generate libraries of compounds. There is no disclosure in the '861 patent concerning application of silane based compositions to a glass fiber and use of a polymeric composition to improve interaction with a gypsum matrix.

U.S. Pat. No. 6,294,253 to Smith, Jr. (hereinafter the '253 patent), discloses a sized, staple fiber product useful in the manufacture of gypsum board. The fiber surface is coated with an aqueous chemical size composition containing a high level of surfactant and optionally, a polymer film former and a biocide. The sized fibers may ultimately be incorporated as reinforcements in the gypsum core of a construction board. Preferred fibers are 5–23 μm in diameter and less than 1.5 inches long. The '253 patent disclosure does not apply a silane based sizing composition and use of a polymeric composition to improve interaction with a gypsum matrix.

U.S. Pat. No. 6,521,086 is directed to a method of making a fiber-reinforced product, such as a fiberglass reinforced gypsum board, by employing the sized staple fiber product delineated by U.S. Pat. No. 6,294,253 to Smith, Jr. (discussed herein above and referred to as the '253 patent).

U.S. Patent Application Publication 2004/0082240 (hereinafter the '240 patent application publication) is directed to a fiberglass non-woven binder. It employs an aqueous solution of a copolymer binder having a monomer or acid functionality and a monomer of hydroxyl or amine functionality. The aqueous solution is applied to hot non-woven fiberglass fibers and heat cured to form a fiberglass mat that is strongly bound, yet flexible. The '240 patent application publication discloses a number of acid functionality monomers and hydroxyl or amine functionality monomers. Specifically, it discloses acrylic acid [para 0011] a carboxylic acid monomer and triethanol amine, an amine functionality monomer that crosslinks without the need for external crosslinking agents [para 0020], The monomer mixture polymerizes or crosslinks when it contacts the hot fiber surface creating a bond at the contact points. This is strictly a creation of bond between two fiberglass fibers, not between a glass fiber and a gypsum matrix. More particularly, the patent does not disclose a bond between a glass fiber and a gypsum matrix when the glass fiber is coated with a silane based sizing.

U.S. Patent Application Publication 2004/0082241 (hereinafter the '241 patent application publication) is directed to a fiberglass non-woven binder. It is a continuation in part of U.S. Patent Application Publication 2004/0082240. It also relates to the use of polyamines as crosslinkers for a polymer binder. It employs an aqueous solution of a copolymer binder having a monomer or acid functionality and a monomer of hydroxyl or amine functionality. The aqueous solution is applied to hot nonwoven fiberglass fibers and heat cured to form a fiberglass mat that is strongly bound, yet flexible. The '241 patent application publication discloses a number of acid functionality monomers and hydroxyl or amine functionality monomers and polyamine crosslinking agents. Specifically, the '241 patent application publication discloses acrylic acid [para 0013], a carboxylic acid monomer and triethanol amine, an amine functionality monomer that crosslinks without the need for external crosslinking agents [para 0023]. The monomer mixture polymerizes or crosslinks when it contacts the hot fiber surface creating a bond at the contact points. This is strictly a creation of a bond between two fiberglass fibers, it is not a bond between a glass fiber and gypsum matrix. In particular, the patent does not disclose formation of a bond between a glass fiber and gypsum matrix when the glass fiber is coated with a silane based sizing.

Notwithstanding the advances in the field of gypsum boards and related articles, there remains a need in the art for a readily and inexpensively produced gypsum board having improved strength and flexure resistance with superior nail pull out resistance.

SUMMARY OF THE INVENTION

The present invention provides a high strength, improved flexure resistant and improved nail pull out resistant gypsum board with glass fiber reinforcement that is bonded to the gypsum matrix through a silane based sizing composition. The sizing, having a thickness of 0.05 to 1 microns, preferably 0.1 to 0.7 microns thick, and more preferably 0.2 to 0.4 microns thick is applied over the surface of glass fibers, attaching to the glass fibers through a hydrophobic moiety of the silane-based sizing. The glass fibers are typically 10 to 24 micrometers in diameter and the 0.05 to 1 micron sizing provides adequate bonding region between the glass fibers and the gypsum matrix. The hydrophobic moiety may be selected from the group consisting of amino, methacryl, or alkyl functional groups. During manufacture of the gypsum board, the glass fiber coated with the silane based sizing is introduced into a wet gypsum slurry.

The wet gypsum slurry contains water soluble monomer mixtures which crosslink during the gypsum curing cycle to form a polymer that creates a bond between the silane based sizing coated glass fiber and the gypsum matrix. The water soluble monomer mixture comprises a monomer with acid functionality and a monomer with hydroxyl or amine functionality. When the monomers interact at high temperatures, such as during gypsum cure, the monomers crosslink to form a polymer of a thickness 0.25 to 24 microns, preferably 0.25 to 6 microns thick. The resultant polymer facilitates the bonding of the glass fibers with the gypsum matrix. The silane based sizing composition may have hydrophilic moieties that protrude into the wet gypsum mixture containing the monomers. The resulting polymer binds with the hydrophilic moieties of the silane based sizing forming a bond. The hydrophilic moiety preferably is poly(ethylene)oxide. During a gypsum cure cycle, the growth of hydrated gypsum crystals occurs generally with an acicular or needle like structure. This growth of gypsum crystals displaces the water that contains the monomer mixtures and progressively directs it towards glass fibers with a silane based sizing. Therefore, the quantity of monomer mixture needed in the gypsum slurry is selected to be in the range of 0.02 to 1 weight percent of the glass fiber weight. During the gypsum cure cycle, the polymer formed from the monomer mixture intertwines with the hydrophilic moieties of the silane based sizing, resulting in an intimate bond between the gypsum matrix and the glass fiber, enabling load transfer between the gypsum matrix and glass fiber and imparting superior flexure strength and nail pullout resistance.

The hydrophilic moieties of the silane based sizing absorbs water and thereby reduces or prevents the formation of voids in the microstructurally identifiable region adjacent to the glass fiber, in contrast with that observed when the glass fiber does not have the silane based sizing. In addition, the removal of water from the microstructurally identifiable region after a gypsum cure cycle changes the crystal structure of calcium sulphate dihydrate in the region. As a result smaller crystals of calcium sulphate dihydrate are nucleated within interstices of larger crystals of calcium sulphate dehydrate, particularly when a sizing of 0.05 to 1 micron thickness is employed. Thus, the microstructurally identifiable region adjacent to the glass fiber with the silane sizing shows a discretely different gypsum matrix microstructure than the region adjacent to the glass fiber without the silane sizing. The microstructure, and the reduction of void formation in the microstructurally identifiable region, results in a superior load transfer between the gypsum matrix and the glass fiber. The superior load transfer provides superior strength, superior flexure resistance and superior nail pull out resistance.

The silane based sizing may be applied as an uncured resin that cures during the gypsum cure cycle. In this case, the uncured resin permeates into the gypsum matrix. The presence of a polymer formed from the monomer mixture incorporated in the gypsum slurry creates an interpenetrating network of polymer and silane based networks. As a result an intimate bond between the gypsum matrix and the glass fiber is created, providing load transfer imparting superior strength, flexure strength and nail pullout resistance.

Hydrophobic moieties of the silane based sizing composition facilitate the firm attachment of the silane composition to the surface of the glass fiber. In one embodiment the silane based sizing composition has branched moieties capable of being cross linked when subjected to high temperature, due to the formation of T type cross links or Q type cross links. The silane based sizing composition with branched moieties is applied to the glass fiber, which is then added to the wet gypsum mixture during gypsum board manufacture. During the gypsum board cure cycle the multiple branched moieties crosslink forming a pseudo polymeric network in the microstructurally identifiable region adjacent to glass fiber resulting in a gypsum matrix with decreased elastic stiffness. This reduced stiffness in the microstructurally identifiable region results in a superior load transfer between the gypsum matrix and glass fiber providing superior strength, superior flexure resistance and superior nail pull out resistance.

The gypsum board is produced in a manufacturing process wherein an aqueous slurry of wet gypsum, having a mixture of monomers with acid functionality and hydroxyl or amine functionality are utilized. The acid functionality monomer is preferably an acrylic acid styrene composition. The hydroxyl or amine functional monomer is preferably triethanolamine. In addition, silane compounds may be added to improve adhesion with glass fibers. The aqueous gypsum slurry must be maintained in an acidic state in order to prevent the precipitation of the monomer mixture; preferably this is accomplished by adding citric acid to the wet gypsum slurry. A typical composition may include 6 mol % of acrylic acid-styrene monomer and 0.4 weight % of silane with triethanolamine and citric acid.

The aqueous gypsum slurry is made by mixing the monomer mixture and at least one member selected from the group consisting of anhydrous calcium sulphate, calcium sulphate hemi-hydrate, hydraulic setting cement, and water. Glass reinforcement fibers coated with a silane based sizing composition may be incorporated into the wet gypsum mix during the mixing of the aqueous slurry. This wet gypsum mix slurry is cast onto a first facer placed on a moving belt. The silane coated fibers may also be laid in the form of organized structures, such as mats, incorporated at specific locations as layers within the cast wet gypsum mix. A second facer sheet is then placed on top of the wet gypsum mix slurry, creating a gypsum sheet. The sheet is cut into separate boards and dried in an oven during a gypsum cure cycle. The bond between the silane based sizing composition, crosslinked monomer mixture and the gypsum matrix occurs during this gypsum cure cycle.

BRIEF DESCRIPTION OF THE DRAWING

The invention will be more fully understood and further advantages will become apparent when reference is had to the following detailed description of the preferred embodiments of the invention and the accompanying drawing, in which:

FIG. 2*a* is a cross-sectional view of a gypsum board, demonstrating one embodiment of the subject invention, showing a glass fiber coated with a silane based sizing with hydrophilic moieties that bonds with a wet gypsum matrix, thereby reducing or eliminating local porosity around the glass fiber; the gypsum matrix is bonded to the glass fiber by the intertwining of the crosslinked monomer mixture with the hydrophilic moieties;

FIG. 2*b* is an exploded view of the near fiber region showing coupling between the sizing and the wet gypsum matrix due to the hydrophilic character of the silicone functional group termination and the crosslinked monomer mixture;

DETAILED DESCRIPTION OF THE INVENTION

Figures 1A, 1B:
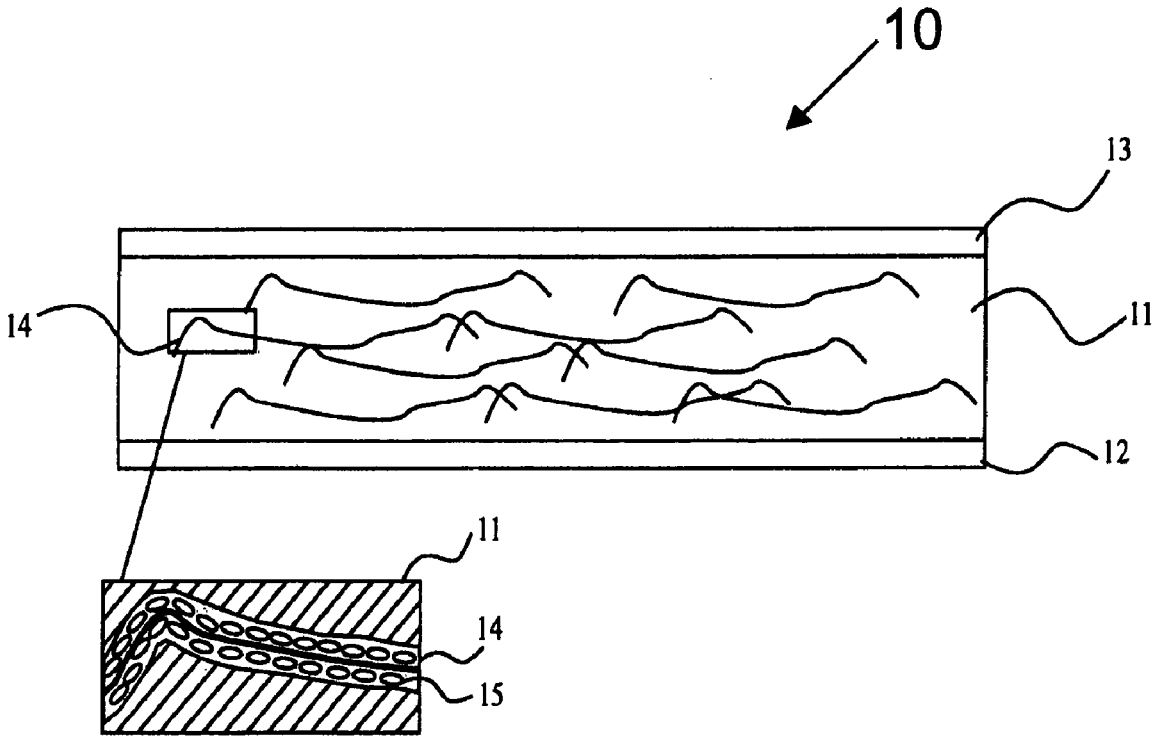
FIG. 1*a* is a cross-sectional view of a conventional gypsum board with a small quantity of glass fibers used for flame resistance showing weak bonding between the glass fibers and the gypsum matrix and voids in the gypsum matrix caused by water evaporation during gypsum board manufacture.
FIG. 1*b* is an exploded view of the glass fiber gypsum matrix interface showing a poor bond between the glass fiber and gypsum matrix, with voids caused by evaporation of water during gypsum board cure.

The present invention provides a gypsum board having glass fibers coated with a silane based sizing. The sizing is separately applied to individual glass fibers. A wet gypsum mix, via an aqueous slurry, is formulated including a monomer mixture comprising a monomer with acidic functionality and a monomer with hydroxyl or amine functionality. The glass fibers coated with the silane based sizing may be incorporated into the wet gypsum mix during the mixing of the aqueous slurry. Alternatively, the silane coated glass fibers may be incorporated into the gypsum matrix in the form of organized structures, such as mats, as layers within the cast wet gypsum mix. Silane based sizing could be created from a variety of silane based compositions.

Gypsum board production has historically used low levels of sized glass fibers to provide fire resistance. In the absence of glass fibers the calcium dihydrate structure of gypsum boards starts to release the water of hydration at a temperature as low as 176° F. The boards subsequently lose strength and crumble due to loss of crystalline structure. In event of a fire, the facer surfaces generally made of Kraft paper burn, resulting in the crumbling of the gypsum board. The glass fibers do not impart any strength or flexibility to the gypsum board since the glass fibers bond poorly to the gypsum matrix. Inadequate bonding is occasioned by the presence of voids created adjacent to the glass fibers in the gypsum matrix by the evaporation of water during gypsum cure.

Silane compositions are typically single or multiple strands of polydimethylsiloxane polymers. Each strand of the polydimethylsiloxane comprises a composition of the type $Me_3SiO[Me_2SiO]_n SiMe_3$, where Me is a methyl group ($CH_3$). The polydimethylsiloxane is more conveniently represented by the formula MDnM. Typically M represents $(Me)_3SiO$, D represents $(Me)_2SiO$ and n represents number of D groups. Polydimethylsiloxane chains may be cross linked using a T member which is $(CH_3)O_2Si$ or a Q member which is $O_4Si$. Silicone fluids are usually straight chains of polydimethylsiloxane (PDMS), which are terminated with a trimethylsilyl group (or groups). PDMS fluids come in all viscosity values—from water-like liquids to intractable fluids. The majority of PDMS fluids are essentially water insoluble. PDMS fluids may be further modified with the addition of organofunctional groups at any point in the polydimethylsiloxane polymer chain. Silicone gels are formed from lightly cross-linked PDMS fluids, where the cross-link is introduced either through a trifunctional silane, such as $CH_3SiCl_3$ giving a "T-branched" silicone structure, or through a chemical reaction between a silicon- vinyl group on one polymer chain and a hydrogen bonded to silicon on another polymer chain. This chemical "tying" of siloxane chains produces a three-dimensional network that can be swollen with PDMS fluids to give a sticky, cohesive mass without form. The basic structure of organofunctional silanes is: $RnSi(OR)_{4-n}$ (with "R" being an alkyl, aryl, or organofunctional group and with "OR" being methoxy, ethoxy, or acetoxy). These chlorosilanes and organofunctional silanes may be oleophobic or hydrophobic for use in textile applications, as well as materials reinforcement coatings. Amino functional groups, commonly used as adhesion promoters, coupling agents, and resin additives, improve the chemical bonding of resins to inorganic fillers and may be used as reinforcing materials in polymeric systems such as epoxies, phenolics, melamines, nylons, PVC, acrylics, poly (olefins), poly(urethanes), and nitrile rubbers. Vinyl functional groups are used for cross-linking polyester, rubber, poly(olefins), styrenics, and acrylics and may be used to couple fiberglass to resins. In addition, vinyl functional groups can copolymerize with ethylene and graft to poly (ethylene) for moisture cure. Methacryl functional groups may also be used for coupling fillers or fiberglass to resins and provide the moisture cross-linking of acrylics. Alkyl functional groups provide hydrophobic surface treatment of fillers and inorganic surfaces. Phenyl functional groups may also provide a hydrophobic surface treatment and may be used as a hydrophobic additive to other silane coupling agents.

In many applications, such as the placement of a sizing on a glass fiber, it is critical for the silane based product to stick (adhere) to the fiber. Whether the silane based product is used as a coating, or an adhesive, a low-surface-energy polymer is being "stuck" to the glass fiber. It is achieved by carefully designing and formulating a silicone that bonds directly with the glass fiber substrate. Hydrophobic functional groups selected the group consisting of amino, methacryl and alkyl groups provide this bonding ability to the glass fibers.

Gypsum board production involves the hydration of calcium sulphate hemihydrate (CaSO4.½H2O) and calcium sulphate anhydrite (CaSO4) forming a microcrystalline structure of gypsum (calcium sulphate dihydrate, CaSO4.2H2O) in an exothermic water-of-hydration reaction. Gypsum expands slightly when forming the dihydrate (0.1 to 0.3%) with stronger gypsum products formed when less water is used during its production (typically 22 mls H2O per 100 grams of powder vs. 50 mls H2O per 100 grams of powder).

Since the gypsum manufacturing process is water based, the silane based polymer sizing must be designed to function in water-based processes and applications. Most silane based polymers are not water-soluble. For aqueous delivery, they are usually formulated as an emulsion—a dispersion of small droplets of silane based composition within an aqueous surfactant solution. Mechanical emulsification and emulsion polymerization also allow silane based compositions that are difficult to handle or manufacture to be used with ease in an aqueous formulation or end application, eliminating the need for solvents to disperse the silane based polymers.

Although most silane based polymers are not water-soluble, there is an important class of water-soluble silane based surfactants. Surfactants are typically polymer molecules with two distinctive regions or "ends"—a hydrophobic (water-fearing) oil-soluble end and a hydrophilic (water-loving) water-soluble moiety. Such a molecule is very effective at stabilizing an oil-water interface. In the case of silane based surfactants, the silane based is the hydrophobic moiety, with the hydrophilic moiety often poly(ethylene) oxide. Silane based surfactants have unique properties, including wetting and emulsification behavior. Unlike many alkyl-based surfactants, they are active in organic media and can be used in either water or solvents.

The glass fibers are coated with a sizing based on silane chemistry. The glass fibers are coated with an appropriate silane composition prior to incorporation of the fibers within the wet gypsum mixture.

The silane composition over the surface of a reinforcing glass fiber is typically 0.05 to 1 micron thick layer, preferably 0.1 to 0.7 microns thick, and more preferably 0.2 to 0.4 microns thick, whereby the silane composition includes hydrophilic moieties having single or cross linked polydimethylsiloxane chains. The hydrophilic moiety preferably is poly(ethylene)oxide. Another hydrophilic moiety is poly (ethylene)amine. The hydrophobic moieties having a silane composition provide bonding functionality with the glass fiber and may be amino, methacryl or alkyl functional groups. The hydrophilic moiety of the silane based sizing dangles free in the aqueous medium and is free to interact with a water molecule in the gypsum wet mix. The hydrophilic moiety of the silane based sizing absorbs water from the gypsum wet mix, thereby reducing the quantity of free water close to the fiber. The gypsum matrix is cured during the gypsum board curing cycle, the absorption of water by the silane composition results in a reduced amount of porosity, thus providing a better bond between the gypsum matrix and glass fiber. The monomer mixture dispersed in the aqueous gypsum slurry also cross links during the gypsum curing cycle. The resulting cross-linked polymer intertwines with the hydrophillic moeity of the silane based sizing, forming a gypsum matrix glass fiber bond layer. The overall gypsum matrix has to be porous enough to release excess water from the gypsum matrix in the form of water vapor. The reduced porosity close to the glass fibers results in improved load transfer between the gypsum matrix and the glass fiber, resulting in a stronger and more flexure tolerant gypsum matrix. The effect of sequestering water by the silane composition results in a gypsum microstructure comprising larger calcium sulphate dihydrate crystals with smaller calcium sulphate dihydrate crystals surrounding the glass fibers. This microstructure results in improved load transfer between the gypsum matrix and the glass fiber The second silane sizing approach comprises an approximately 0.05 to 1 microns thick highly branched silane based sizing which is coated onto a fiber in an uncured state. The branches of the silicone sizing require a curing cycle to accomplish cross-linking of branched PDMS chains. As with the single chain silane sizing, the branched chain silicone sizing has hydrophobic moieties including amino, methacryl or alkyl groups which function to bond the silane based sizing to the glass fiber. When the sizing coated glass fiber is introduced into wet gypsum slurry, the highly branched silane based sizing in the uncured state permeates freely into the wet gypsum mixture forming a pseudo interpenetrating polymer network within the gypsum matrix. The aqueous gypsum slurry comprises a monomer mixture which progressively migrates towards the glass fiber as gypsum crystals are formed. Therefore, the quantity of monomer mixture needed in the gypsum slurry is selected to be in the range of 0.02 to 1 weight percent of the glass fiber weight. During the gypsum cure cycle both the silane based branched polymer network and the crosslinking of the monomer mixture results in an intertwined polymer network within the gypsum matrix adjacent to the glass fiber. The concentration of the silane based sizing and the cross-linked monomer mixture in the gypsum matrix decreases exponentially as a function of distance from the glass fiber gypsum interface. The chemistry of the sizing is chosen so that the branched chains of the silane based sizing within the gypsum matrix cross-links at essentially the same temperature as used in the cure conditions of the gypsum board. The silane coating penetrates the wet gypsum matrix in the unpolymerized state, whereupon curing results in the polymerization of the silicone polymer. Alternatively, the silane based sizing may melt during the gypsum curing cycle and permeate the gypsum matrix during cooling create a polymer network in the gypsum matrix, again forming an interpenetrating network with the cross-linked monomer mixture. This process forms a decreased modulus contact region and a mechanical link between the glass and the gypsum matrix capable of withstanding gypsum board flexure without fiber breakage. In addition, this contact results in improved load distribution between the gypsum matrix and the glass fiber resulting in better strength properties of the gypsum reinforced matrix.

Using these approaches, the sizing chemistry on glass fibers and the monomer mixture in the gypsum slurry can be tailored to enable the production of gypsum boards with superior dry-strength, flexure resistance, nail pullout resistance and fire-resistant properties.

Referring to FIG. 1*a* of the drawings, there is shown generally at 10 a cross-sectional view of a conventional gypsum board. The gypsum board 10 has a gypsum matrix 11 with a small quantity of glass fibers 14 incorporated therein for use in providing flame resistance to the gypsum board 10. The gypsum board 10 has a top and a bottom. The gypsum board 10 has a first facer 12 at the bottom and a second facer 13 at the top. The facer sheets are commonly made from Kraft paper. An exploded view of the glass fiber gypsum matrix interface is shown at FIG. 1*b*, showing the poor bonding properties between the glass fibers 14 and the gypsum matrix 11. These poor bonding properties result in lack of load transfer between the gypsum matrix and the glass fiber. Load transfer is additionally compromised by the presence of voids 15 between the glass fibers 14 and the gypsum matrix 11. These voids 15 are caused by the evaporation of water during gypsum board cure. These glass fibers 14 are added to the wet gypsum slurry and typically do not form a well laid reinforcement structure. There is no load transfer between the gypsum matrix 11 and the glass fibers 14 and therefore, the glass fibers 14 do not provide any strength or flexural resistance to the gypsum board. During a fire event, the face Kraft paper is burnt and the gypsum matrix 11 loses water of hydration at approximately 176° F. and crumbles to a powder. The glass fibers 14 provide some structure and prevent the complete collapse of the gypsum board 10, even though there is no residual appreciable strength by the gypsum board 10 after a fire event.

Referring to FIG. 2*a* there is shown a cross-sectional view of a gypsum board 20 manufactured according to one embodiment of the subject invention. The gypsum board has a first facer sheet 12 and a second facer sheet 13. Glass fibers 14 are coated with a silane based sizing composition. The silane based sizing composition couples with a wet gypsum matrix 11 in the region adjacent to the glass fibers 14. FIG. 2*b* is an exploded view of this adjacent region at 16. Coupling is due to the hydrophilic character of the silicone functional group termination and the cross-linking of the monomer mixture shown at 18 as a hatched region. The hydrophilic character absorbs some of the water close to the fiber and the quantity of water vapor released during the gypsum cure is decreased, resulting in reduction or absence of void formation in the region, as shown at 16. Smaller crystals of calcium sulphate dihydrate are formed within larger crystals of calcium sulphate dihydrate crystals adjacent to the fiber due to this water absorption effect as shown at region 16.

Figures 3A, 3B:
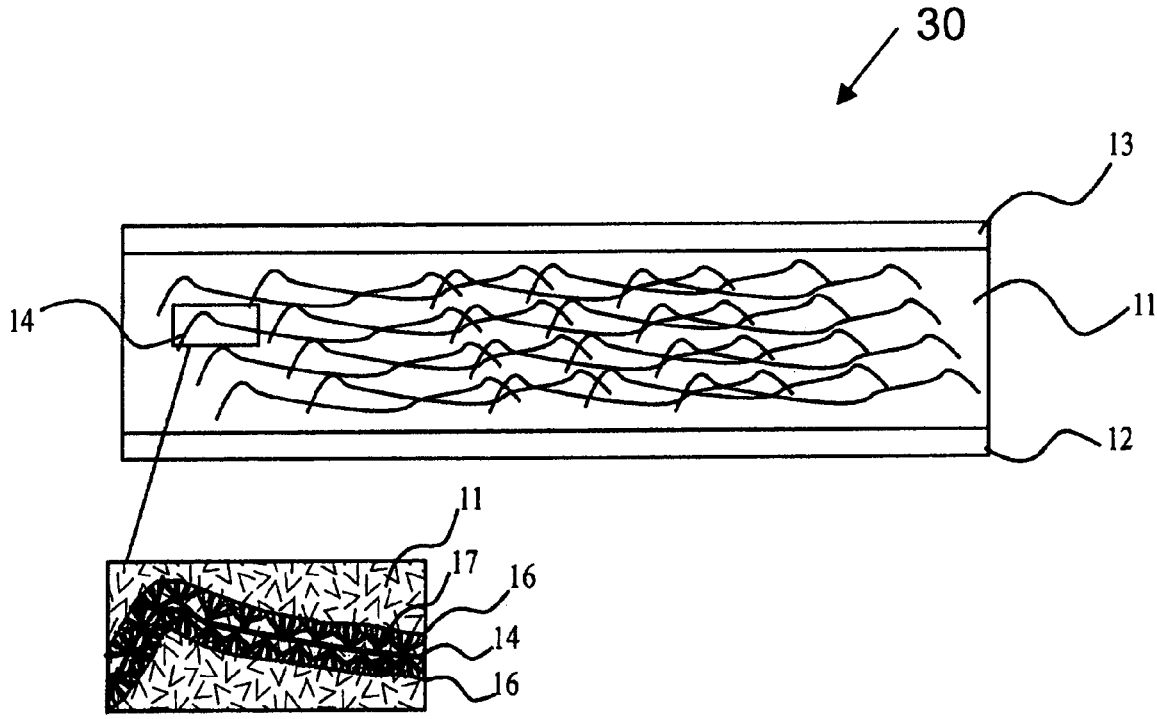
FIG. 3*a* is a cross-sectional view of a gypsum board demonstrating a second embodiment of the subject invention wherein a glass fiber coated with a silane based sizing penetrates the gypsum matrix forming branched moieties of a hardened pseudo polymer network that interpenetrates polymeric network formed by the crosslinking of monomer mixture incorporated in the gypsum slurry during gypsum cure.
FIG. 3*b* is an exploded view depicting a narrow region adjacent to the fiber, wherein the wet gypsum mixture and the sizing termination and the crosslinked monomer mixture diffuse into each other.

Referring to FIG. 3*a* there is shown a cross-sectional view of a gypsum board at 30 according to a second embodiment of the subject invention. A glass fiber 14 is coated first with a cross-linking multi branched silane based sizing composition. When this sizing coated fiber is incorporated into a wet gypsum mix, the wet gypsum mixture and the sizing diffuse into each other in a narrow region adjacent to the fiber. This narrow region is shown at 16 in FIG. 3*b*, which is an exploded view of the near fiber region. The gypsum slurry with monomer mixture during cure results in cross-linking of the multi branched silane based sizing composition and cross-linking of the monomer mixture shown at 18 as a hatched region resulting in a pseudo polymeric network 17 embedded within the gypsum matrix 11 adjacent to the glass fiber 14 surface. The concentration of this pseudo polymeric network is highest next to the glass fiber 14 and decreases exponentially as a function of the distance away from the glass fiber 14 gypsum matrix 11 interface. The pseudo polymeric network decreases the elastic modulus and stiffness of the gypsum matrix adjacent to the fiber resulting in a more compliant resilient matrix that transfers load to the glass fiber without fiber breakage.

The present improved gypsum board production method comprises the steps of: coating the glass fibers with a silane based sizing, laying fibers in the form or organized structures (such as mats or keeping loose bundles of coated glass fibers), forming an aqueous slurry comprising at least one of anhydrous calcium sulphate, calcium sulphate hemi-hydrate, and hydraulic setting cement; mixing aqueous gypsum slurry with the loose bundles of coated glass fibers, distributing the aqueous slurry to form a layer on a first facing sheet, preferably Kraft paper; applying organized fiber structures within the slurry, applying a second facing sheet, preferably Kraft paper, onto the top of the layer; separating the resultant board into individual articles; and drying the articles. The product of the invention is ordinarily of a form known in the building trades as board, i.e. a product having a width and a length substantially greater than its thickness. Gypsum and other hydraulic set and cementitious board products are typically furnished commercially in nominal widths of at least 2 feet, and more commonly 4 feet. Lengths are generally at least 2 feet, but more commonly are 8–12 feet. The mechanical properties of the manufactured gypsum board were measured by standard measurement procedures, using an Instron type universal testing machine. The mechanical properties included flexure strength and nail pullout resistance.

A glass fiber free gypsum matrix (stucco) shows a flexural strength of 0.0096 kN with a standard deviation of 0.009 kN. The standard process of water laid glass fibers in a gypsum board exhibits a flexural strength of 0.105 kN with a standard deviation of 0.005 kN, showing the improvement of flexural strength due to the incorporation of fibers. In contrast, the flexural strength of monomer incorporated gypsum slurry with silane based sized glass fibers results in a flexural strength of 0.102 kN with a standard deviation of 0.01 KN.

The nail pullout strength of gypsum matrix (stucco) is 0.180 kN with a standard deviation of 0.022 kN. The standard process of water laid glass fibers in gypsum matrix shows a nail pullout resistance of 0.259 kN with a standard deviation of 0.023 kN. In contrast, the nail pullout resistance of monomer incorporated gypsum slurry with silane based sized glass fibers is 0.268 kN with a standard deviation of 0.024.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A gypsum board, comprising:

a. a gypsum matrix formed from an aqueous acidic gypsum slurry, said gypsum matrix having a bottom and a top and being appointed to be cured to form said gypsum board;

b. a first facer sheet placed on said bottom of said gypsum matrix;

c. a second facer sheet placed on said top of said gypsum matrix;

d. one or more glass fibers placed within said gypsum matrix;

e. said aqueous acidic gypsum slurry comprising a monomer mixture composed of a monomer having acidic functionality and a monomer having hydroxyl or amine functionality, said acidic function monomer and hydroxyl or amine functionality monomer being adapted to cross-link to form a cross-linked monomer mixture; and f. a silane based sizing composition coating said glass fibers, said silane based sizing composition interacting with said monomer mixture during said curing of said gypsum board such that said gypsum matrix and said monomer mixture harden into an interpenetrating pseudo polymeric network within a microstructurally identifiable bond region adjacent to said glass fibers within said gypsum matrix, whereby said silane based sizing composition coating and said cross-linked monomer mixture provide increased strength, flexure resistance and nail pull out resistance to said gypsum board.

2. A gypsum board as recited by claim 1, wherein each of said first and said second facer sheets is comprised of Kraft paper.

3. A gypsum board as recited by claim 1, wherein said gypsum matrix comprises calcium sulphate hemihydrate ($CaSO_4 \cdot ½H_2O$), calcium sulphate anhydrite ($CaSO_4$), hydraulic setting cement and water.

4. A gypsum board as recited by claim 3, wherein said hydraulic setting cement is selected from the group consisting of Portland cements, sulphate resisting cements, blast furnace cements, pozzolanic cements, and high alumina cements.

5. A gypsum board recited by claim 1, wherein said silane based sizing composition together with cross linked monomer mixture has a thickness ranging from about 0.05 to 1 microns.

6. A gypsum board as recited by claim 5, wherein said silane based sizing composition together with cross linked monomer mixture has a thickness ranging from about 0.25 to 6 microns.

7. A gypsum board as recited, by claim 1, wherein said silane based sizing composition coating comprises polymethylsiloxane.

8. A gypsum board as recited by claim 1, wherein said monomer having acidic functionality is acrylic acid and styrene.

9. A gypsum board as recited by claim 1, wherein said monomer having hydroxyl or amine functionality is triethanolamine.

10. A gypsum board as recited by claim 1, wherein said aqueous acidic gypsum slurry comprises citric acid.

11. A gypsum board as recited by claim 1, wherein said aqueous acidic gypsum slurry comprises silane based additives for enhancing bonding with said glass fibers.

12. A gypsum board as recited by claim 1, wherein said monomer mixture in the said aqueous acidic gypsum slurry comprises 0.02 to 1 weight percent of glass fibers incorporated in said gypsum matrix.

13. A gypsum board as recited by claim 1, wherein said silane based sizing composition includes a hydrophobic moiety, and said hydrophobic moiety functions to cause said silane based sizing composition to adhere to said glass fibers.

14. A gypsum board as recited by claim 1, wherein said silane based sizing composition includes a hydrophilic moiety, and said hydrophilic moiety interacts with water and the said monomer mixture present in said gypsum mix.

15. A gypsum board as recited by claim 14, wherein said hydrophobic moiety is a member selected from the group consisting of an amino group, a methacryl group and an alkyl functional group.

16. A gypsum board as recited by claim 14, wherein said hydrophilic moiety comprises poly(ethylene)oxide or poly (ethylene)amine.

17. A gypsum board as recited by claim 1, wherein said silane based sizing composition comprises a plurality of silane molecules having single or cross linked polydimethylsiloxane chains.

18. A gypsum board as recited by claim 1, wherein said silane based sizing composition comprises a plurality of silane molecules having multi branched chains.

19. A gypsum board as recited by claim 18, wherein said plurality of silane molecules having multi branched chains are cross-linked with a T type cross-link that hardens into said pseudo polymer network during gypsum cure.

20. A gypsum board as recited by claim 18, wherein said plurality of silane molecules having multi branched chains are crosslinked with a Q type cross link that hardens into said pseudo polymer network during gypsum cure.

21. A gypsum board as recited by claim 1, wherein said silane based sizing composition is multi branched with a hydrophobic termination attached to said glass fiber, and said multi branched silane based sizing composition diffuses into said gypsum matrix, whereby said gypsum matrix and said monomer mixture harden into said interpenetrating pseudo polymeric network.

* * * * *